US006581236B2

(12) United States Patent
Jennings

(10) Patent No.: US 6,581,236 B2
(45) Date of Patent: Jun. 24, 2003

(54) SUBSTANCE SPREADING IMPLEMENT

(76) Inventor: Paul E. Jennings, 1210 SE. 23rd Ter., Cape Coral, FL (US) 33990

( * ) Notice: Subject to any disclaimer, the term of this patent is extended or adjusted under 35 U.S.C. 154(b) by 14 days.

(21) Appl. No.: 09/892,438

(22) Filed: Jun. 28, 2001

(65) Prior Publication Data

US 2003/0000038 A1 Jan. 2, 2003

(51) Int. Cl.[7] ..... A46B 3/22

(52) U.S. Cl. ..... 15/188; 15/245.1; 15/144.1; 15/144.2

(58) Field of Search ..... 15/104.001, 144.1, 15/144.2, 187, 188, 245, 245.1

(56) References Cited

U.S. PATENT DOCUMENTS 1,939,344 A * 12/1933 Garland
2,054,233 A * 9/1936 Young
2,333,801 A * 11/1943 Lowston
3,315,296 A * 4/1967 Richardson
3,465,377 A * 9/1969 Thomas
6,108,854 A * 8/2000 Dingert

FOREIGN PATENT DOCUMENTS

GB 2163044 * 2/1986
WO WO 94/04057 * 3/1994
WO WO 96/25067 * 8/1996

* cited by examiner

*Primary Examiner*—Terrence R. Till

(57) ABSTRACT

The invention is concerned with an implement for spreading a powdery cleaning material on surfaces that have been contaminated with fluids dropping from vehicular traffic. The powdery material needs to be evenly spread over the contaminated surfaces while at the same time undergoing an abrading action relative to the surface to be cleaned. The implement consists of a rectangular block having a rubber sheet overlying its bottom surface with the sheet being fastened to the longitudinal side surfaces of the block. The rubber sheet on the bottom of the block and facing the surface to be cleaned has a tire-like tread profile thereon. A handle is attached to a top surface of the block.

5 Claims, 3 Drawing Sheets

FIG. 4
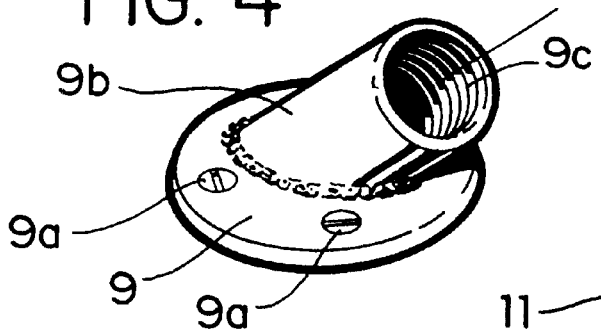
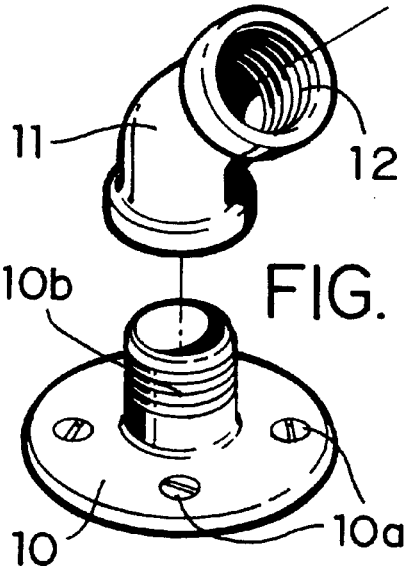
FIG. 5
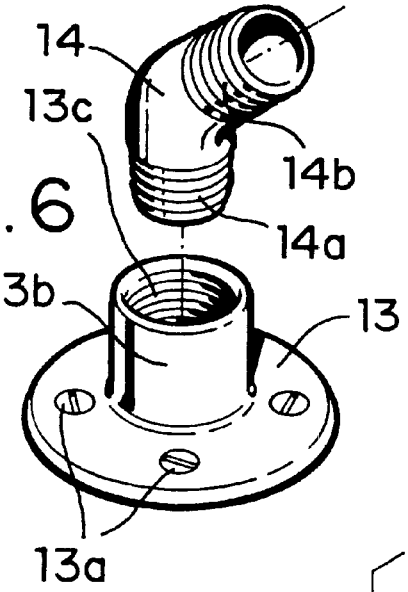
FIG. 6
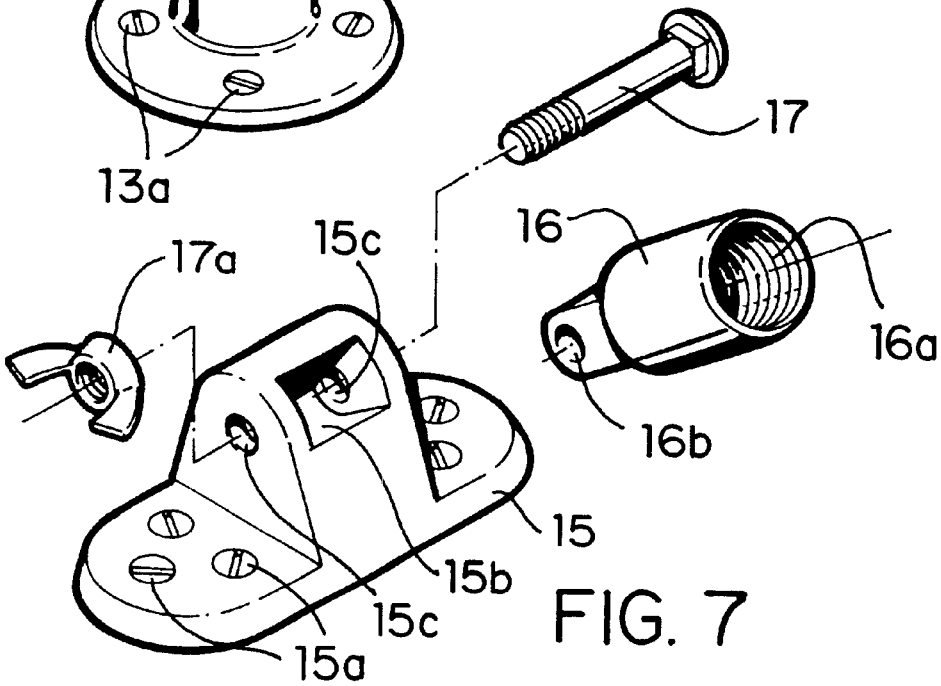
FIG. 7

SUBSTANCE SPREADING IMPLEMENT

BACKGROUND OF THE INVENTION

This invention relates to a substance spreading implement or tool. The substance that needs to be spread is a powdery substance consisting of clay components. Such a substance is disclosed in my prior U.S. Pat. No. 5,723,424. It is a cleaning mixture that is being spread on concrete surfaces that have been contaminated with oil and other fluids that have been dropped from automobiles in gas stations, drive-throughs, drive ways, parking areas and other areas wherever internal combustion engines in vehicles are operating. As disclosed in the above identified patent, this powdery clay composition has to be applied to the contaminated concrete surfaces and should be evenly spread thereon. Many different implements have been tried in order to accomplish this spreading action such as brooms having bristles or the well known Squeegees. However, these attempts have not proven themselves to be satisfactory in operation and performance. It has been found that an abrading action should be associated with the spreading action. There are no implements, spreaders or applicators on the market and, therefore, readily available that satisfy the noted actions.

OBJECTS OF THE INVENTION

An object of the invention is to provide a simple and inexpensive tool, applicator or implement to spread a powdery cleaning substance on a surface of concrete and to obtain some abrading action. The implement itself consists of a piece of rectangular wood or other substance such as plastic to which is attached a piece of rubber resembling a tire tread. such tire treads can be obtained from old tires that are cut up into strips or they can be obtained from tire re-tread stations that have ready-made strips of tire treads that are ready to be applied to used tires in a vulcanization process. The final implement has enough weight so that no more manual pressure needs to be applied when moving the implement over the powdery substance that is already on the concrete surface.

BRIEF DESCRIPTION OF THE DRAWINGS

FIG. 4 is a view of the connecting element

FIG. 5 is another view of the connecting elements to the implement

FIG. 6 is still another version of connecting a handle to the implement

FIG. 7 shows a more complicated version of connecting a handle to the implement

DETAILED DESCRIPTION OF THE DRAWINGS

Figure 1:
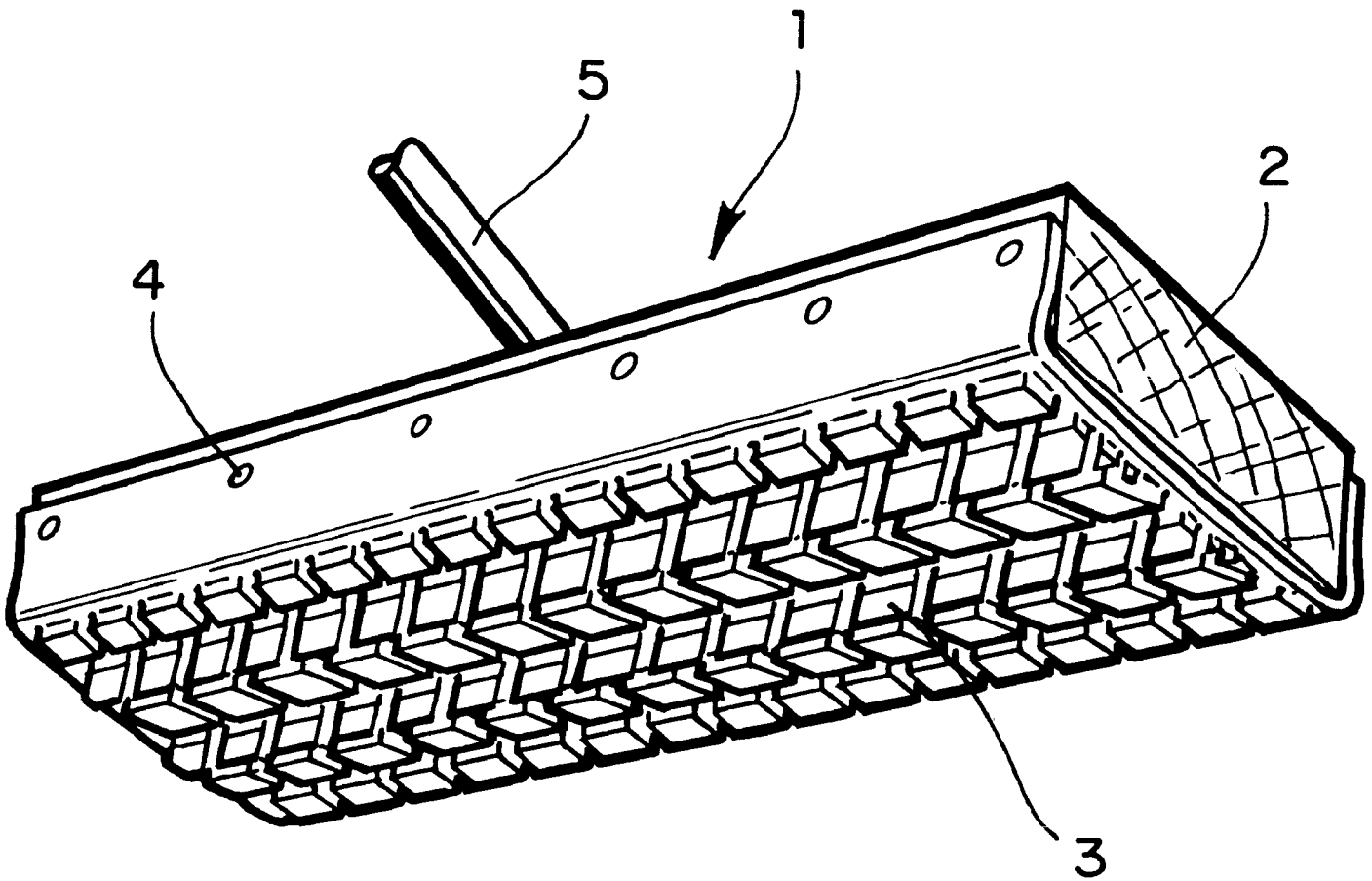
FIG. 1 is a perspective view of the spreading implement

FIG. 1 shows a perspective view of the invention as indicated at 1. The basic invention consists of a rectangular block of either wood or some other material such as plastic. An elongated piece of rubber is being attached to the longitudinal sides of the rectangular block by nails screws or rivets 4. This piece of rubber 4 can be cut from a vehicle tire having a tread thereon or it could be cut from strips of rubber having a tread thereon that are used to retread worn tires in a vulcanizing process. It is important that the rubber on the bottom of the implement to have somewhat of a curve transverse to the longitudinal direction of the rectangular block. This way, when the implement is in use, the rubber will give somewhat with respect to any unevenesses on the concrete surface and will have an abrading action when the powdery substance is being spread. The numeral 5 represents a handle that is being attached to the rectangular block 2.

Figure 2:
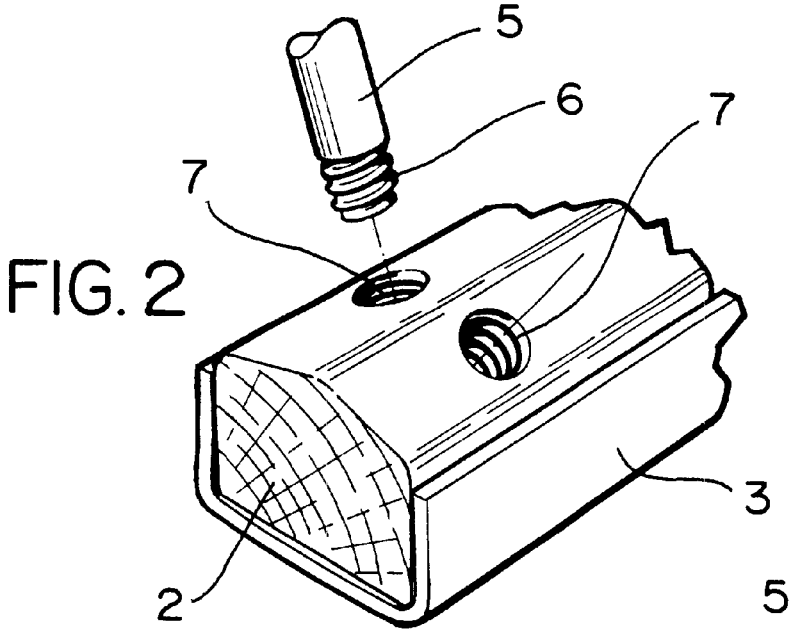
FIG. 2 is a more detailed perspective view of the invention

FIG. 2 is a top and perspective view of the implement showing a way of how the handle 5 may be attached to the rectangular block 2. For this purpose, one end of the handle 5 may have male threads 6 and the block 2 may have female threads 7 to receive the male threads 6 of the handle 5. The attachment of the handle to the block should be angulated to keep the bottom surface rubber parallel with the concrete similar to what is known in the art of brooms.

Figure 3:
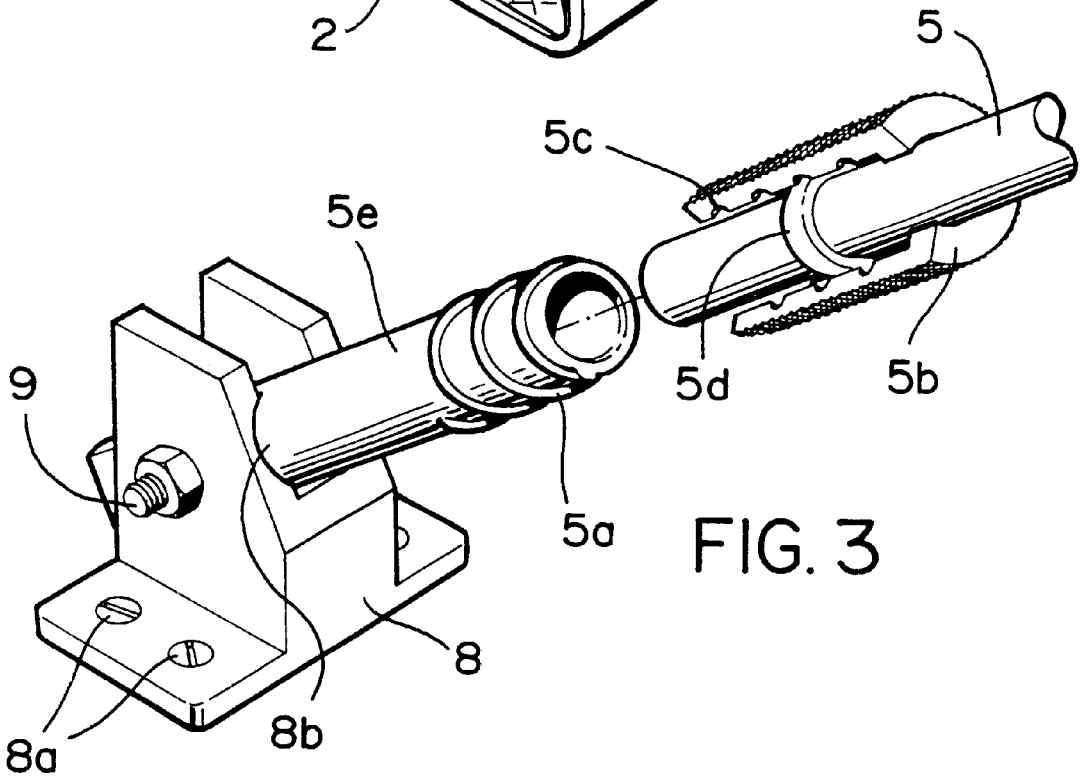
FIG. 3 is a detailed view of the connection of a handle to the implement

FIG. 3 shows still another way of attaching the handle 5 to the rectangular block 2. In this case a bifurcated attachment block 8 is being used having a round bore **8*b* in its bifurcation which snugly will receive the handle 5 and will be kept in place by a bolt and nut 9. The bifurcated block 8 is mounted to the rectangular block by way of screws 8*a*. Although it is not necessary for simplicity reasons, the handle 5 may be detachable from the bifurcated block 8 or from any other handle combination. For this purpose, a short and hollow section handle 5*e* has a threaded section 5*a* on its exterior which is screwed into an internally thread 5*c* of sleeve 5*b*. The handle 5 is received within the hollow section 5*e* and further has a stop ring 5*d* thereon which abuts against the outer end the short section 5*e*. By turning the sleeve 5*b*, the threads 5*a* and 5*c*** will engage each other and make a tight connection.

FIG. 4 shows still another way of attaching handle 5 to the block 2 of the implement. A simple flange 9 is attached to the block 2 by way of screws **9*a*. The flange 9 has a hollow angular extension 9*b* which has interior threads 9*c*. The interior threads 9*c* are to receive the exterior threads 6 (FIG. 2) of handle 5. The extension 9*b* is angulated so that the handle 5 will orient the implement at its proper angle as was discussed in FIG. 2**.

FIG. 5 shows a flange 10 with a right angle extension having external threads **10*b* thereon. The flange 10 is fastened to the rectangular block 2 by way of screws 10*a*. In order to obtain the proper angulation between the handle and the implement, an elbow 11** having interior threads is provided.

FIG. 6 shows the reverse of FIG. 5 in that the right angle extension **13*b* of flange 13 has interior threads 13*c* to receive the exterior threads 14*a* of elbow 14. The elbow 14 has exterior threads 14*b* which could receive the sleeve 5*b* (FIG. 3). The Flange 13 of FIG. 6 is fastened to the rectangular block 2 by way of screws 13*a***.

Turning now to FIG. 7, there is shown a different way of attaching the handle 5 to the rectangular block 2. The flange 15 is fastened to the rectangular block 2 by way of screws **15*a*. An extension of the flange 15 has a recess 15*b* which will receive a connecting element 16 which has at one end thereof a bore 16*b* which end is fitted in the recess 15*b*. The extension of the flange 15 has two bores 15*c* spanning the recess 15*b* and once the bore 16*b* of the connecting element 16 is received in the recess 15*b* and aligned with bores 15*c*, a bolt 17 is passed through the bores, a wing nut 17*a* is threaded onto the bolt 17 and tightened to complete the assembly. The connecting element 16** has an interior thread

16*a* at its end opposite from the bore 16*b*. This interior thread 16*a* will receive the exterior thread 6 of handle 5 (FIG. 2). This type of connection allows the handle to swivel with respect to the rectangular block 2 so that a person working with the implement will always keep the bottom surface of the implement parallel to the surface being worked upon regardless of that persons working stance.

What I claim is:

1. A spreading implement for spreading a powdery substance on a surface to be cleaned, comprising a rectangular block having a bottom surface and longitudinal side surfaces, a pliable sheet of rubber extending over said bottom surface, means for attaching said sheet to said longitudinal side surfaces of said block, said sheet extending over said bottom surface has on its surface facing the surface to be cleaned tire-like tread profiles thereon, a handle is attached to a top of said block.

2. The spreading implement of claim 1, wherein said block is made of wood.

3. The spreading implement of claim 1, wherein said block is made of a plastic material.

4. The spreading implement of claim 1 including means for rigidly attaching said handle at an angle on said top of said block.

5. The spreading implement of claim 1, wherein said handle can swivel relative to the top of said block.

* * * * *